US005797148A

United States Patent [19]

Kivelä

[11] Patent Number: 5,797,148

[45] Date of Patent: Aug. 25, 1998

[54] TOILET SEAT

[75] Inventor: Antti Kivelä, Jämsä, Finland

[73] Assignee: Nobi Oy, Jämsä, Finland

[21] Appl. No.: 718,498

[22] PCT Filed: Mar. 17, 1995

[86] PCT No.: PCT/FI95/00144

§ 371 Date: Oct. 1, 1996

§ 102(e) Date: Oct. 1, 1996

[87] PCT Pub. No.: WO95/27430

PCT Pub. Date: Oct. 19, 1995

[30] Foreign Application Priority Data

Apr. 12, 1994 [FI] Finland ..... 941682

[51] Int. Cl.[6] ..... A47K 13/00

[52] U.S. Cl. ..... 4/235; 4/237

[58] Field of Search ..... 4/235, 239, 254, 4/234, 237

[56] References Cited

U.S. PATENT DOCUMENTS

| | | | |
|---|---|---|---|
| D. 160,033 | 9/1950 | Thomas . | |
| D. 290,035 | 5/1987 | Mann et al. . | |
| 1,886,595 | 11/1932 | Sandquist . | |
| 2,155,577 | 4/1939 | Zaio | 4/235 |
| 2,358,265 | 9/1944 | Thomas . | |
| 2,463,049 | 3/1949 | Onsa | 4/254 |
| 2,548,238 | 4/1951 | Potts et al. . | |
| 2,645,784 | 7/1953 | Blackburn | 4/235 |
| 3,574,242 | 4/1971 | Trowbridge | 4/254 |
| 3,594,831 | 7/1971 | Brewer . | |
| 4,635,303 | 1/1987 | Shih . | |
| 4,977,628 | 12/1990 | Barrett . | |
| 5,384,917 | 1/1995 | Epling | 4/235 |
| 5,448,781 | 9/1995 | Miller | 4/235 |

FOREIGN PATENT DOCUMENTS

| | | |
|---|---|---|
| 3032052 | 4/1982 | Germany . |
| 3621451 | 1/1987 | Germany . |
| 3622853 | 1/1987 | Germany . |
| 73078834 | 7/1975 | Sweden . |
| 75049569 | 8/1978 | Sweden . |
| 464332 | 4/1991 | Sweden . |

*Primary Examiner*—David J. Walczak
*Attorney, Agent, or Firm*—Browdy and Neimark

[57] ABSTRACT

The present invention relates to a seating portion of a toilet seat (10). The seating portion according to the present invention comprises a seat ring (12) and hand and/or arm rests or support means (14) extending closely adjacent to or from the seat ring (12). A prior art seat ring can be easily replaced by the seating portion according to the present invention.

12 Claims, 3 Drawing Sheets

TOILET SEAT

The present invention relates to a toilet seat according to the preamble of claim 1 and especially to the cover or seating portion of a toilet seat, the seating portion being provided with suitable hand and/or arm rests or supports to assist a person to sit down and get up from said seat.

It has been prior known to provide toilet seats with auxiliary devices which, for example, have helped the aged or the disabled to sit down to and to get up from the toilet seat. According to a known type of solutions, suitable support elements are mounted to the wall or on to the floor elements of the bathroom or lavatory room. DE patent application 30 32 052 being mentioned hereby as an example of such arrangements. Eventhough the presented solutions are per se steady and efficient, the assembly of them has, however, involved some problems due to the difficult and labor consuming and thus expensive fixing, as well as, in many cases due to the lack of a proper fixing spot. Furthermore, in bathroom conditions it is usually not desirable to drill holes, for example, in tiles or similar floor or wall elements, since moisture may enter the structures of a building through such holes and can thus cause serious damages. Furthermore, the assembly of such space consuming support arrangements into the usually small and close toilet rooms is difficult.

According to an another type of solution the body of the toilet seat is provided with supporting handles. Such solutions are disclosed for instance in DE patent applications 36 21 451 and 36 22 853 and in open laid SE documents 377656, 403429 and 464332. In the presented arrangements various types of support beams and mechanisms made from pipes and/or rods or similar means are assembled in connection with the seat and adapted for being at least partly pivotable away from around the seat portion. However, the disclosed arrangements present several disadvantages. All of the disclosed arrangements comprise several pivoted parts, the use of such not being easy for, for example, aged or disabled persons. Furthermore, eventhough the arrangements are presented as to be fixed to the body of the seat, they need particular additional supports, since the lever effort caused by a long support handle or arm member can break the toilet seat body around the fixing spot or even overturn the whole seat. Additionally, this type of structures assembled around the seat cause a significant inconvenience to the cleaning and sanitation of the toilet seat and the toilet room and thus a disadvantage in view of a common level of hygiene. Said products have proven to be relatively expensive to manufacture and assemble and thus it is only in institutional use they have become more common.

The object of the present invention is to overcome the disadvantages of the prior art and to provide a totally new solution for a support member of a toilet seat. The objective is a support member for hands or arms, said member being simple as to its construction, easy to manufacture and to assemble to the seat, light and easy to use and economical to manufacture.

A further object of the present invention is to provide a support member for a toilet seat, which is easy to clean and which does not hinder the cleaning of the surroundings of the seat.

A still further object of the present invention is to provide a combination of a support member and a seat ring, by which it is easy to substitute an old, original seat ring.

An additional object of the present invention is to provide a toilet seat arrangement, in which the user can choose whether he or she wants the support member to be provided at both sides of the user, only at one side, or not at all.

A still additional object of the invention is to provide a toilet seat arrangement which is provided with necessary safety devices to prevent the user from falling off the seat.

A still additional object of the present invention is to provide a toilet seat arrangement which is provided with integrated means by which it is possible to adjust the size of the aperture of a seat ring of the toilet seat.

The present invention is based on the idea that by making the seat portion of a toilet seat, for instance the ring-like or similar part, upon which one sits and the support members as a combination, preferably as one integrated assembly, a toilet seat is provided, which realizes the above mentioned objects.

More precisely, the toilet seat according to the present invention is mainly characterized by what is disclosed in appended claims 1 to 13 and especially by the characterizing portion of claim 1.

According to one preferred embodiment of the present invention the seat portion of a toilet seat is manufactured from a suitable material, such as plastics, by moulding or forming such that the seat portion's ring-like part or similar means facilitating sitting, and the supporting means form one integrated assembly. The manufacturing thereof can be realized in one ore more stages. The supporting means extend preferably upwardly from the seat portion. Said supporting means formed to extend upwardly from said seat portion can additionally extend either backwards from the front of said seat or from back to front or from the middle of the periphery of the seat ring to front and/or back of said seat portion. It is preferred to make the whole seat ring and the supporting means assembly to be pivotable in the same way as a normal seat cover. Is is also usually preferred to provide said seat with a seat cover portion which is arranged to open and close between said supporting means.

According to one alternative embodiment the seat ring and the supporting means are manufactured separately and from different materials, but fitted to be cooperative such that in use said ring and supporting means operate as one single unit or part.

According to an another embodiment support means are extending closely adjacent to the seat portion of a toilet seat, but said support means not being an integrated part with the seat ring of the toilet seat. The support means may be arranged as to be separate means extending below said seat ring, for example from a separate, preferably pivotable plate or rod means or from the toilet seat body.

When needed, the supporting means can be provided with a plurality of additional features, such as different adjusting means or means for easy removal and assembly of said supporting means.

The seat ring and supporting means assembly may be constructed such that an old seat ring can be easily replaced by it. A new, unused toilet seat can be, of course, provided with seat ring means according to the present invention.

According to one embodiment of the present invention the toilet seat is provided with suitable means for reducing the size of the aperture of the seat ring. This feature is especially useful when some of the users, but not all, are small children or disabled.

According to one embodiment the toilet seat is provided with safety belts or similar means to hold a person on the seat ring and to be used by persons having difficulties to remain seated, for example due to some injury, or persons who require an additional support to be able to remain seated in a pleasant position and to prevent them from falling off the seat.

Significant advantages are obtained by the present invention. The seat ring and supporting means assembly according to the present invention is easy to manufacture and to fit to a toilet seat and thus provides low total costs. It is light and easy to use, since in normal use the user does not need to move or swing any additional moving parts when compared to an prior art seat. The stresses caused to the toilet seat body by the support members decrease, since by the structure according to the invention the significant twisting moments caused by long levers according to the prior art are avoided. Additionally, the sanitation of the surroundings of the toilet seat is made easier, since no projecting parts, which are troublesome to clean, extend from said supporting member. Furthermore, the material of said supporting member can be chosen such that it can be easily designed and manufactured so as to be easy to keep clean.

In the following the present invention and the other objects and advantages thereof will be described by way of an example with reference to the annexed drawings, in which similar reference characters throughout the various figures refer to similar features. It should be understood that the following description of an example of the invention is not meant to restrict the invention to the specific forms presented in this connection but rather the present invention is meant to cover all modifications, similarities and alternatives which are included in the spirit and scope of the present invention, as defined by the appended claims. For example, it is apparent to the skilled man that the expression toilet seat refers to any kinds of seat arrangements used in lavatories, such as chemical, electrical, water closet or dry toilet seats and that non-continuous seat portion arrangements are also included in the expression seat ring in this connection.

Figure 1:
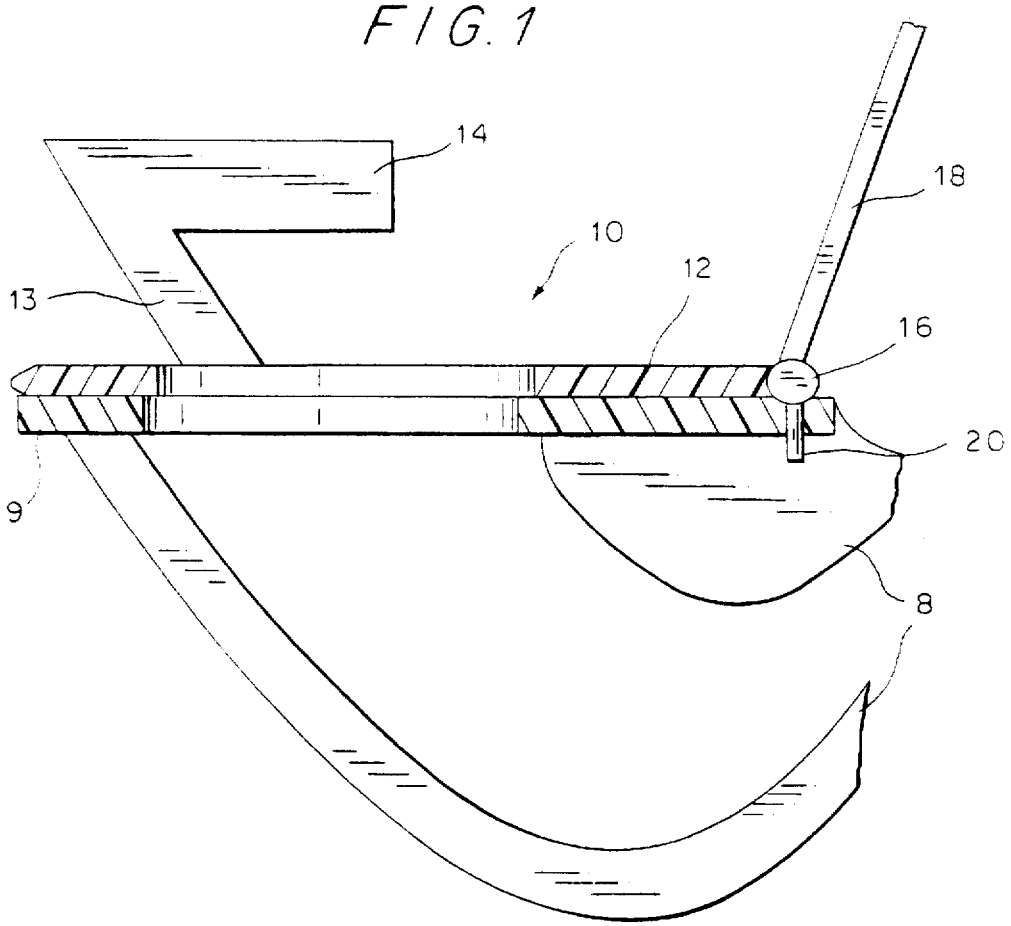
FIG. 1 is a simplified schematic side view shown partially in section of a seat portion of a toilet seat according to the present invention.
Figure 3:
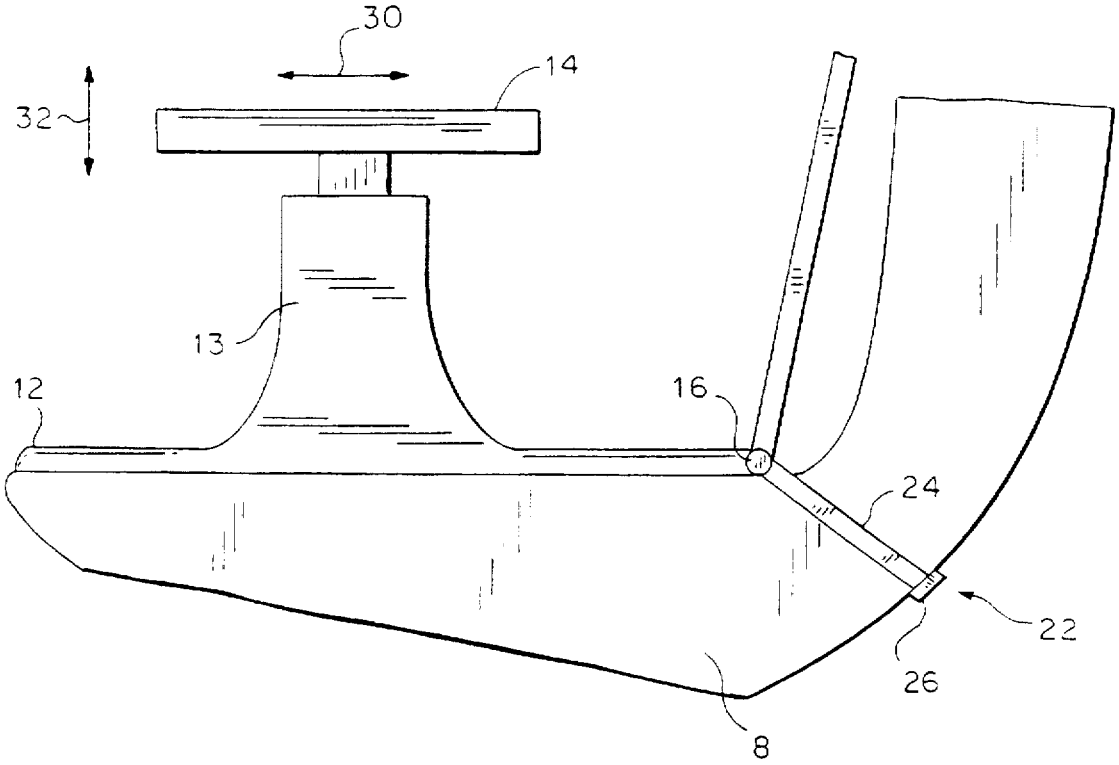
FIG. 3 is a schematic side view of an alternative embodiment according to the present invention, showing adjustable supporting, means.
Figure 4:
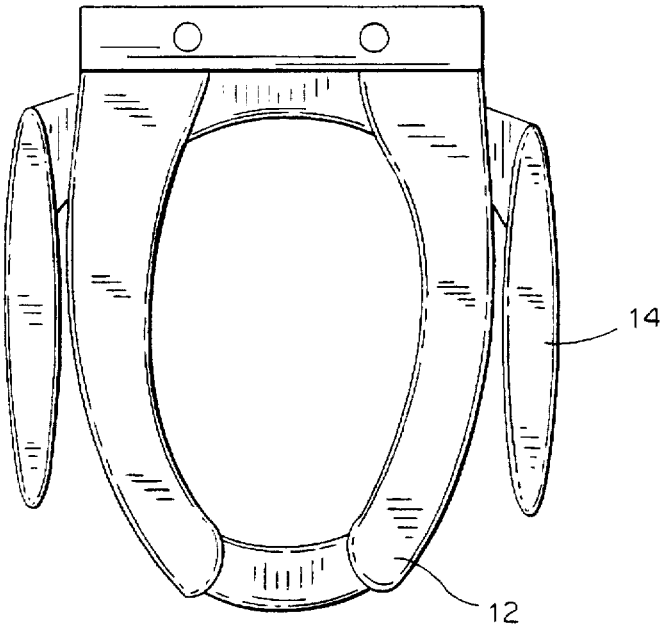
FIG. 4 is a top view of a further embodiment of the invention.

In a schematic view of FIG. 1 a portion of a toilet seat generally designated 10 is shown. Said seat 10 comprises a body 8 and fitted above the same a seat part or seat ring 1 2 according to one embodiment of the present invention, said seat ring being preferably of a suitable plastic material. It should be noted that the seat portion can be of any other suitable material, such as wood, aluminium, or the like and that it does not have to form a full closed circle, but it can be formed from, for example, two parts both having the shape of a banana. Supporting means 14 extend from said seat ring 12, said supporting means being provided such that they are integrated with the seat ring 12 as one single unit 13. The seat portion with the ring 12 and the supporting means 14 may preferably be adapted and designed to fit the special needs and requirements of various groups of users (such as aged people, children, disabled persons). The supporting means can also be adjustable by suitable means, as shown in FIG. 3.

It should be understood, that the supporting means 14 can be of any shape and that there may be only one support means and that in view of the present invention it is essential that the support means extend from the seat ring or from a point closely adjacent thereto, for instance such that the supporting means are extending from the body 8 of the seat below the seat ring or are suitably mounted to the body 8 or to the counterpart 9 of the seat ring beneath the seat ring 12. The toilet seat can also be provided with means placed beneath or aside the seat ring 12, for instance with suitable plate or rod means (not shown), from which the support means are extending.

FIG. 1 shows also a pivoting point 16, around which the seat ring 12 according to the present invention and the integrated supporting means 14 can be swung, when needed, to the up-lifted position thereof (not shown, but equals the position in which cover 18 is shown). Cover means 18 are also shown, the cover means being usually preferably pivoted so as to form an assembly with said seat ring 12 and to be pivotable around the same pivoting point. In the example shown in FIG. 1 the whole seat portion with its supporting means and cover is fixed in point 20 to the seat body 8. The fixing point may comprise a normal standardized fixing point or a fixing point and a manner for mounting otherwise commonly used for seat rings.

Figure 2:
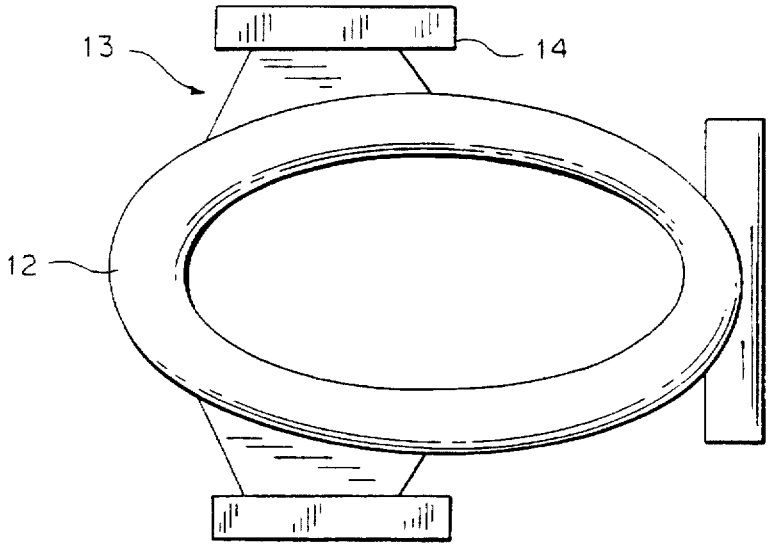
FIG. 2 is a top view of a seat portion according to the present invention.

It can be easily seen from FIG. 2 that the supporting means 14 and the seat ring 12 form an integrated assembly. There are no such new holes or cavities or concealed parts difficult to clean compared to those existing prior art toilet seats not provided with supporting means, and thus a significant disadvantage of the prior art supports or rests is avoided.

As can be seen from the figures, the supporting members according to the present invention do not form a lever arm of any significant length between the body portion 8 of the toilet seat 10 and the seat ring 12, nor in view of the attachment point 20 of the seating structure 12. Therefore a firm enough fixing to the body 8 of the toilet seat 10 is provided by assembling the seat ring according to the present invention to the points of attachment 20 of the old seat ring, as shown in FIG. 1. However, an additional securing, such as 22 shown in FIG. 3, can be used when needed. In FIG. 3 an additional securing is provided by an attaching band 24, which can be of, for instance, suitable plastic material, the band being wounded around the "neck portion" of the body 8 of the seat and tightened by tightening means 26. The means for attachment of the seat ring according to the invention can also be provided with a threaded pin or screw 22' extending through a part of the body 8 and a nut 26' (see FIG. 6) which is tightened on the end of the pin 22' extending through the seat body.

An embodiment of adjustable supporting means is also shown in FIG. 3. The possibilities for adjustment of the supporting means of said embodiment are illustrated by arrows 30 and 32, but it should be noted that the adjustment of the supporting means is also easily arranged in the direction of the width of the seat and that the supporting means can easily be turned into a suitable angle relative to the seating portion.

Figure 5:
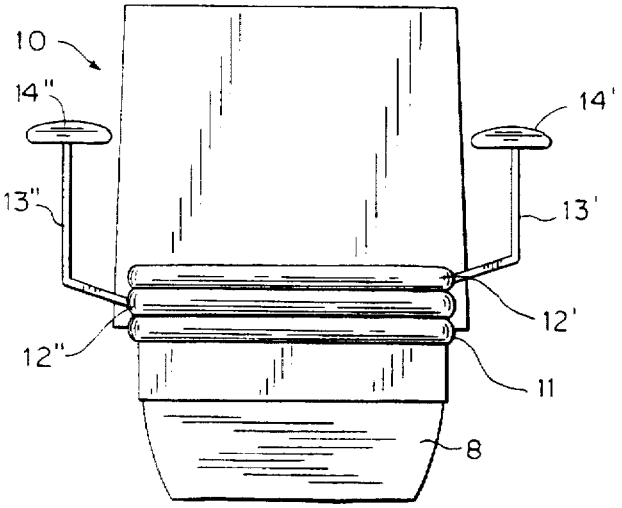
FIG. 5 is a schematic view of a further embodiment of the invention.
Figure 6:
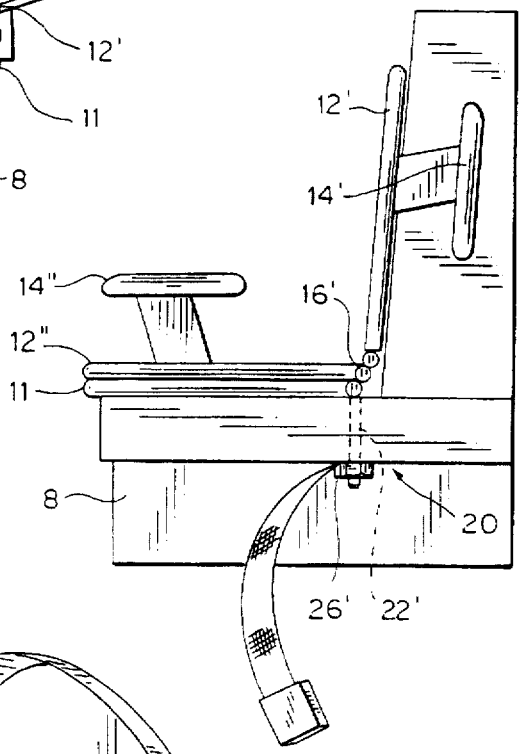
FIG. 6 is a side view of the embodiment shown in FIG. 5.

In FIG. 5 a further embodiment of the present invention is shown in somewhat schematic presentation from the front of the seat. In this embodiment the toilet seat 10 is provided with a seat ring assembly which comprises three different ring portions 11, 12' and 12". The same embodiment is also shown in FIG. 6, but now from the side thereof with the uppermost ring 12' in an up-lifted position. The arrangement is such that the user can easily choose whether he or she wants to use two, one or no supports or rests while using the toilet seat 10, since the rings are pivotally attached to the body 8 by hinging means 16' such that the rings 11, 12' and 12" can be separately pivoted to and off from the body of the toilet seat.

The hinging arrangement 16' is preferably such that the order of the rings 12' and 12" can be easily changed, and thus the seat can be adjusted so as to be easily used by those who only prefer a left handed or alternatively a right handed support or rest.

FIG. 6 shows also an important feature of the invention according to which the supporting means can be easily lifted up and away from the opening of the toilet seat and thus the toilet seat can be used as a normal toilet seat, the only ring left above the toilet seat body being a prior art type seat ring 11. A safety belt 40 is fastened by securing member 22.

Figure 7:
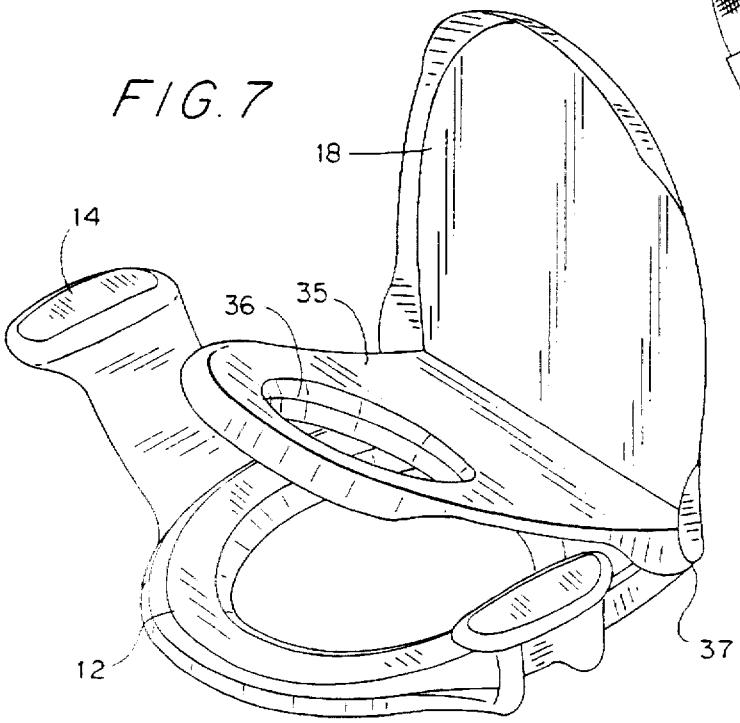
FIG. 7 is a perspective view of a preferred embodiment of the present invention.

According to one preferred embodiment shown in FIG. 7, the seat portion 12 according to the present invention is also provided with one or several additional ring means 35, the apertures 36 thereof being of different sizes and/or shapes, by means of which the seat can be adjusted to be suitable, for example, to small children or disabled or other groups having special requirements in view of the size or shape of the opening of the ring. Such an additional integrated ring 35 is preferably adapted to be pivotable around the pivotal point 37 of the seat ring between the position of use and to the upper position, which equals the up-lifted position of the seat cover 18. In a preferred embodiment the arrangement is such that when the additional ring 35 is not used it is preferably placed inside the sidewalls of cover 18 and can be swung simultaneously with said cover.

According to one further embodiment (not shown) of the present invention the seat ring assembly is provided with safety belts or similar means which may be attached to the back portion of the seat ring i.e. close to the attachment point 20 of the seat ring assembly. Such belts and various alternatives thereof are per se known from other types of use, but can be easily adapted to said ring, fro example to the back corners thereof, or close to that to provide an additional support to a person using the toilet seat and in some cases to prevent him or her from falling off from said seat.

The foregoing discloses some preferred embodiments according to the invention but it is clear to those skilled in the art that the invention can be modified and applied in many other ways without departing from the spirit and scope of the present invention defined in the appended claims. For example, it should be understood that the seat ring according to the invention and the supporting means integrated with it can be arranged to be tiltable or such, that the height of the seat ring can be adjusted, and even such that the other side of the ring can be adjusted to a different height, so that those handicapped having, for example, pains in the hips, will find sitting on the seat ring, sitting down and rising off pleasant and easy.

I claim:

1. A toilet seat assembly for a user to use a toilet seat, the toilet seat assembly comprising:

at least two seat rings (12,35; 12',12") adapted to be mounted adjacent to a toilet bowl rim and placed one upon another, including an uppermost seat ring and a lower seat ring;

each of the seat rings being a seat for the user to sit upon and having a respective outer edge;

at least one of the seat rings (12;12',12") including at least one support (14;14',14") which extends from the outer edge thereof on at least one side thereof and intermediate front and back portions thereof, and wherein the support extends substantially upwardly above a top surface plane of the uppermost seat ring (35; 12"), whereby sitting down on and rising up from said toilet seat assembly is facilitated;

said at least one support (14;14',14") and said seat ring which includes said support (12;12',12") comprising an integrally molded one-piece unit (13;13',13").

2. The toilet seat assembly according to claim 1, comprising a pivot at a pivoting point (16';37) wherein the integrated unit of the seat ring and support is pivotable so as to be swung simultaneously with and all other seat rings (12',12'; 12,35).

3. The toilet seat assembly according to claim 1, further including a toilet seat cover (18), a pivot at a pivoting point (37) wherein the cover (18) is pivotable so as to be swung simultaneously with and all other seat rings (12,35), and wherein said uppermost seat ring (35) fits inside said seat cover (18) when said seat ring is not in use.

4. The toilet seat assembly according to claim 1, wherein said lower seat ring (12) includes a lower seat ring aperture and said uppermost seat ring (35) includes an upper seat ring aperture (36) different in size or shape from said lower seat ring aperture, whereby the size or shape is selectable by the user.

5. The toilet seat assembly according to claim 1, wherein said seat rings (12',12") are pivotally placed one upon another and said seat rings are provided with respective supports (14',14") on a single side thereof, the respective supports being disposed oppositely such that a first one (12') of the seat rings includes one of the supports (14') on a first side of the seat ring assembly and a second one of the seat rings (12") includes another one of the supports (14") on a second side of the seat ring assembly, whereby the user is facilitated to choose one of the supports (14',14") on either the first side or the second side.

6. The toilet seat assembly according to claim 1, wherein said material is a plastic material.

7. The toilet seat assembly according to claim 1, wherein the support (14) is adjustable according to personal requirements of the user.

8. The toilet seat assembly according to claim 1, wherein said seat rings (12,35; 12',12") are pivotally placed one upon another and provided with supports (14; 14',14") attachable to a body portion (8) of the toilet seat (10) by a threaded pin extendable through a part of the body portion and a nut tightened on the end of the pin.

9. The toilet seat assembly according to claim 1, wherein said at least two seat ring means (12,35; 12',12") are pivotally placed one upon another and provided with supports (14; 14',14") attachable to a body portion (8) of said toilet seat (10) by a threaded pin extending through a part of the body portion and a nut tightened on the end of the pin, and further comprising additional means (22;22') for attachment of said seat rings to the body portion (8) of said toilet seat (10).

10. The toilet seat assembly according to claim 9, wherein said additional means (22) for attachment comprise a band (24) extending around said body (8) of said toilet seat (10) and suitable means (26) for tightening and securing said band.

11. The toilet seat assembly according to claim 1, comprising safety belt means to give further support to the user.

12. The toilet seat assembly according to claim 1, wherein each of the seat rings has the outer edge defining an outer periphery of a toilet seat ring in sides of the toilet seat ring between front and back portions thereof.

* * * * *